US006663056B1

(12) United States Patent
Lee

(10) Patent No.: US 6,663,056 B1
(45) Date of Patent: Dec. 16, 2003

(54) WRIST CUSHION

(76) Inventor: Vincent K. Lee, 4F, No. 48, Lane 10, Chi Fu Rd., Taipei 114 (TW)

( * ) Notice: Subject to any disclaimer, the term of this patent is extended or adjusted under 35 U.S.C. 154(b) by 0 days.

(21) Appl. No.: 10/283,043

(22) Filed: Oct. 30, 2002

(30) Foreign Application Priority Data

Aug. 30, 2002 (TW) ..... 91213573 U

(51) Int. Cl.[7] ..... B43L 15/00
(52) U.S. Cl. ..... 248/118.1; 248/118; 248/918
(58) Field of Search ..... 248/118, 118.1, 248/918, 346.11; 446/227; 400/715

(56) References Cited

U.S. PATENT DOCUMENTS

D175,089 S * 7/1955 Newmark et al.
3,188,040 A * 6/1965 Eichler ..... 248/346.11
5,104,699 A * 4/1992 Pantaleo et al.
5,256,457 A * 10/1993 Pantaleo et al.
5,679,193 A * 10/1997 Yates et al.
5,807,156 A * 9/1998 Owen ..... 446/77
6,016,138 A * 1/2000 Harskamp
6,089,516 A * 7/2000 Yates
6,171,560 B1 * 1/2001 Pesu et al.
6,219,867 B1 * 4/2001 Yates
6,268,027 B1 * 7/2001 Wu ..... 428/13
6,314,598 B1 * 11/2001 Yates
6,380,926 B1 * 4/2002 Ho
6,484,425 B1 * 11/2002 Hirsch ..... 40/406
6,494,418 B1 * 12/2002 Wolf et al.
6,499,703 B2 * 12/2002 Chou

OTHER PUBLICATIONS

US Patent Publication, US 2002/0077577A1 to Coger, Jun. 2002, Typing Protecttant.*
US Patent Publication, US 2002/0157163A1 to Chen, Oct. 2002, Transparent Comfort Device.*
Internet Website http://www.pro–pad. com, Good Raise Chemical, dated 1999.*
Internet Website http://www.ergotech.com, Ergotech, 2000.*

* cited by examiner

*Primary Examiner*—Ramon O. Ramirez
*Assistant Examiner*—Amy J Sterling
(74) *Attorney, Agent, or Firm*—Troxell Law Office PLLC

(57) ABSTRACT

A wrist cushion includes a pad portion, a transparent shell portion bonded to an upper side of the pad portion, and a transparent top portion bonded to and covering a whole upper surface of the pad and the shell portions. The shell portion has mono or dual liquids and ornamental floating articles contained therein. The top portion has predetermined softness, elasticity, and thickness to protect the shell portion against undesired piercing by pointed things and leakage of the mono or dual liquids while enables movements of the liquids and the floating articles to be seen from outside of the wrist cushion.

7 Claims, 5 Drawing Sheets

WRIST CUSHION

BACKGROUND OF THE INVENTION

With the prosperous and rapid developments in the industrial and commercial fields, people's living quality has been largely and constantly upgraded. As a result, most consumers have higher requirements for the products they intend to purchase. The products that meet consumers' requirements must economically provide good basic functions and have novel and unique designs. One of the ways to make an item that is displayed or arranged in the room and always appears before users more attractive and more useful is to add another new structure to the original product without adversely influencing its appearance and intended function. A wrist cushion for positioning below a user's wrist during manipulating a mouse is an example of the above-mentioned item that is frequently used and may be improved to show a novel appearance to attract more consumers.

FIG. 1 is a perspective view of a conventional wrist cushion for positioning below a user's wrist during manipulating a mouse. The wrist cushion is typically made of a soft and elastic material, such as silicon rubber, to be a transparent product. However, the material, such as the silicon rubber, that provides sufficient softness and elasticity is usually viscid plastic or rubber material having high viscosity. That is, the conventional wrist cushion made of such high-viscosity material is not fluid at all. Thus, any ornamental article provided inside the conventional wrist cushion is maintained in a static state. In some cases, the conventional wrist cushion is simply a transparent cushion made of silicon rubber without any internal ornamental article and has a monotonous appearance.

It is therefore tried by the inventor to develop an improved wrist cushion that is novel and unique because it includes fluids and movable internal ornaments to show dynamic views.

SUMMARY OF THE INVENTION

A primary object of the present invention is to provide a wrist cushion that includes a soft and elastic top portion for a user to comfortably rest a wrist thereon, and a shell portion having ornamental articles movably positioned therein. Both the shell and the top portions are transparent for users to see the movable ornamental articles from outside of the wrist cushion.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
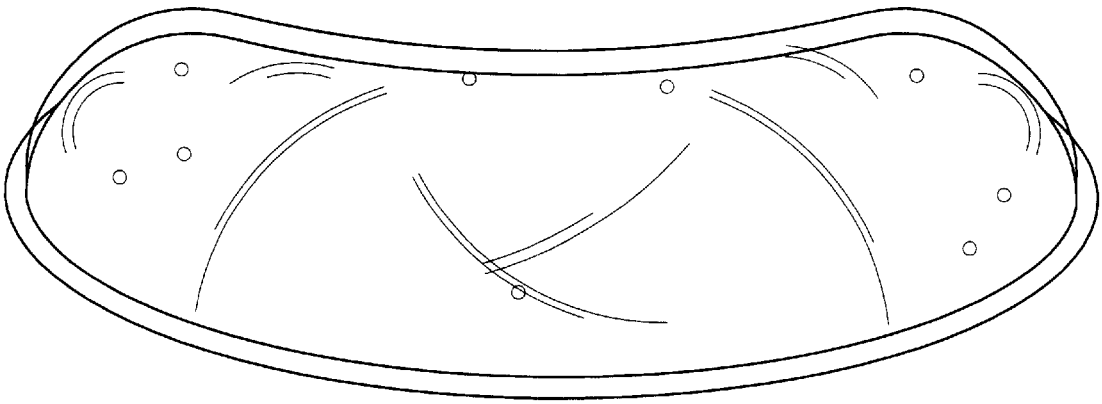
FIG 1 PRIOR ART
FIG. 1 is perspective view of a conventional wrist cushion.
Figure 2:
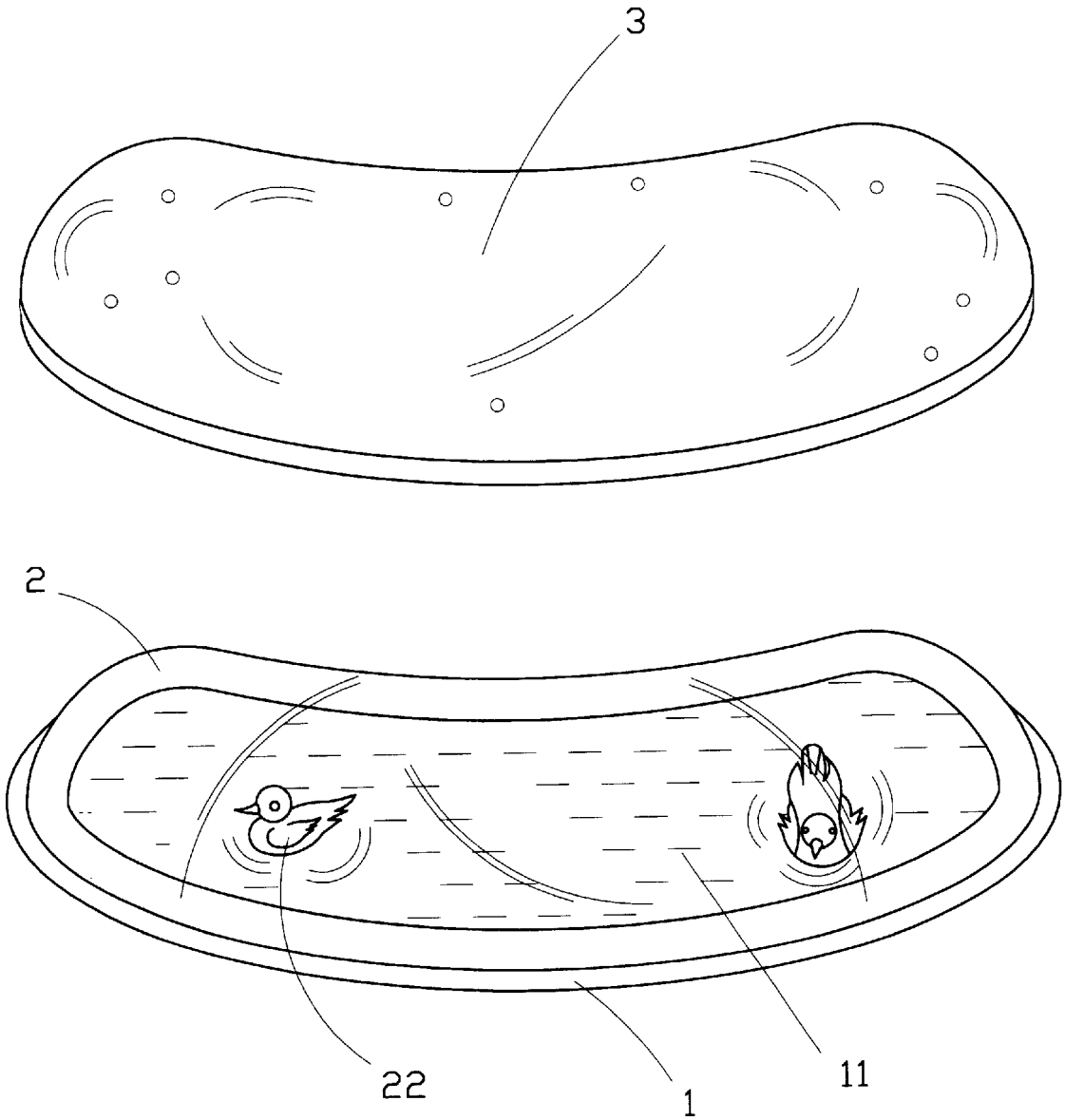
FIG. 2 is an exploded perspective view of a wrist cushion according to an embodiment of the present invention.
Figure 3:
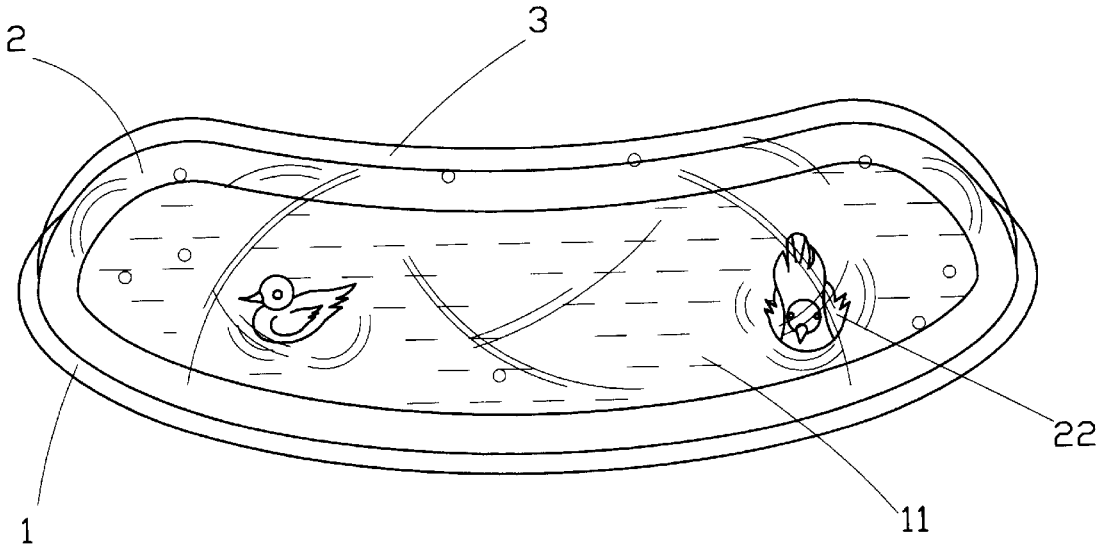
FIG. 3 is an assembled perspective view of FIG. 2.
Figure 4:
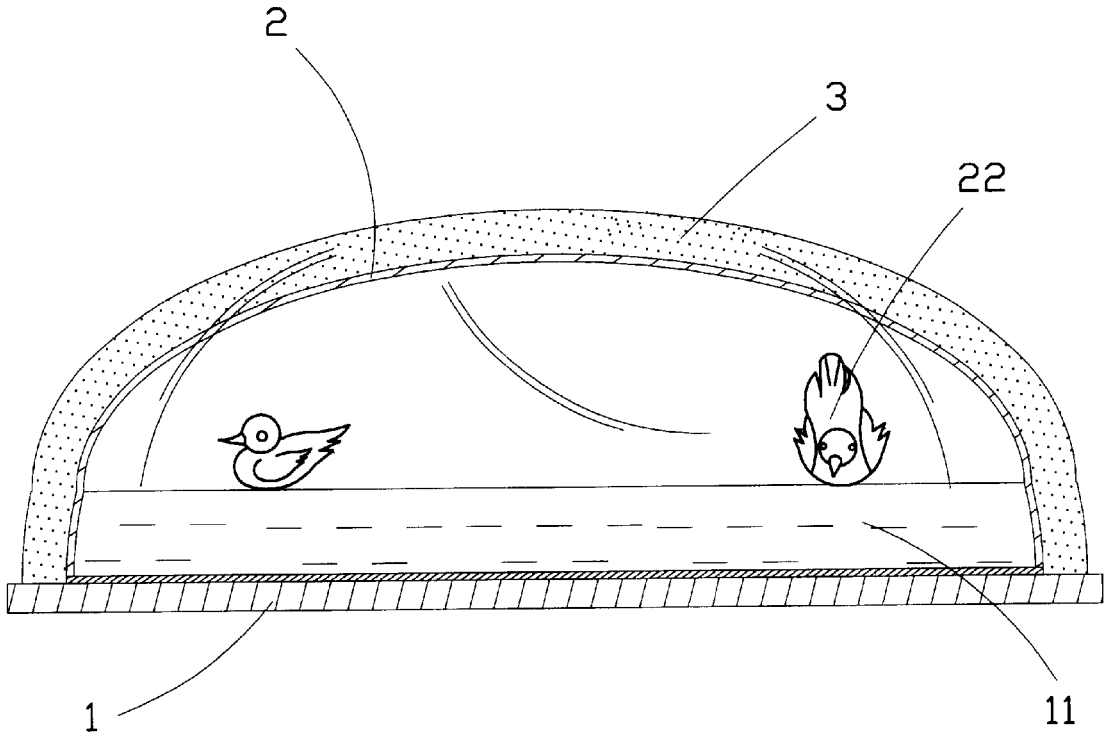
FIG. 4 is a sectional view of FIG. 3.

Please refer to FIGS. 2, 3, and 4 that are exploded perspective, assembled perspective, and sectional views, respectively, of a wrist cushion according to an embodiment of the present invention. As shown, the wrist cushion mainly includes a pad portion 1 forming a base of the wrist cushion, a transparent shell portion 2 connected to an upper side of the pad portion 1 and having one or two types of liquid 11 and ornamental floating articles 22 contained therein, and a top portion 3 connected to the pad portion 1 to cover the entire shell portion 2.

Figure 5:
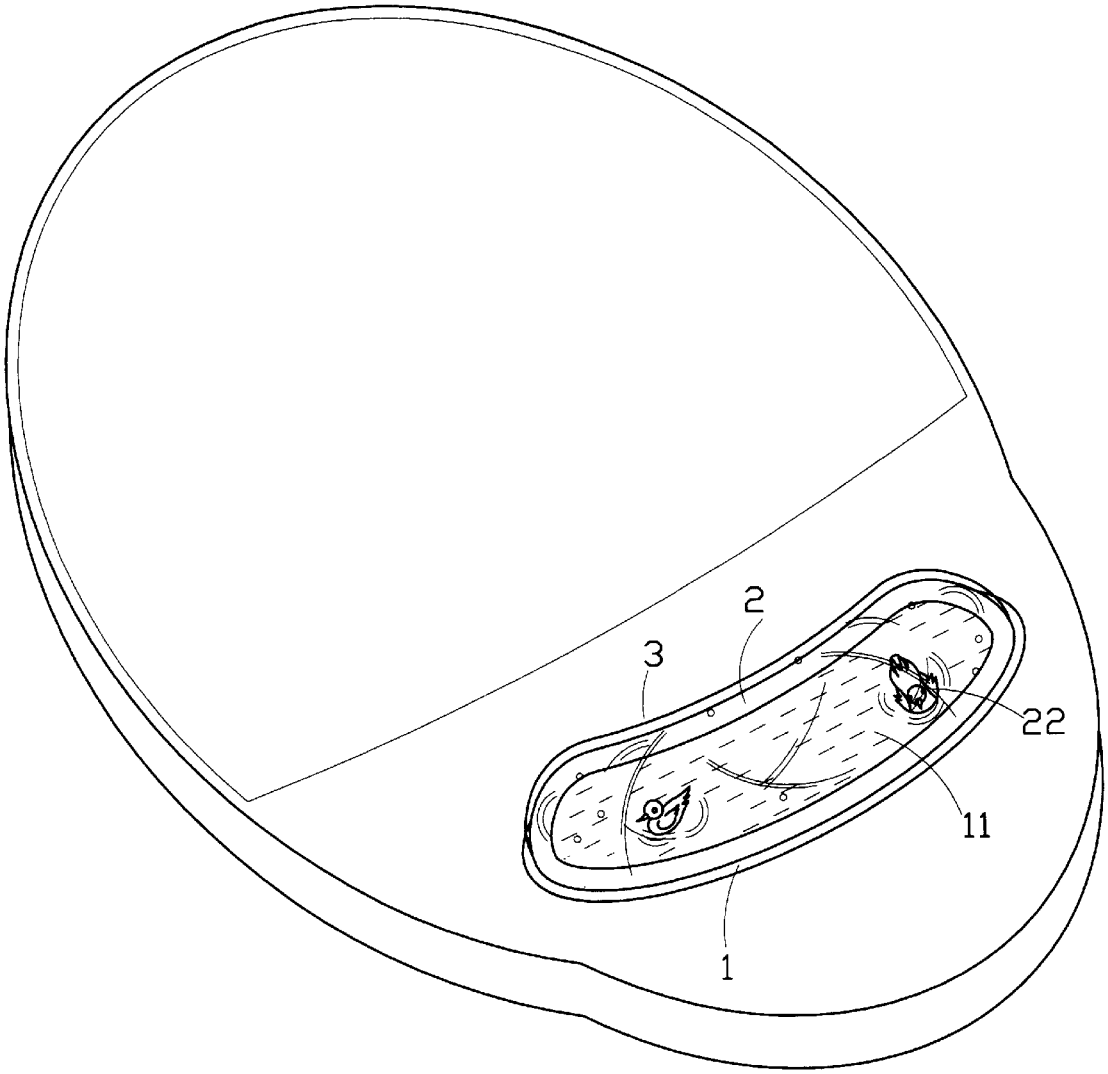
FIG. 5 shows the wrist cushion of the present invention attached to a large pad.

The transparent shell portion 2 containing mono or dual liquids 11 and ornamental floating articles 22 may be connected to the upper side of the pad portion 1 with a suitable bonding agent, so that the shell portion 2 and the pad portion 1 together form an integral unit, as shown in FIG. 3. FIG. 5 shows another embodiment of the present invention, in which the wrist cushion is set in and projected from a pad having an area larger than that of the pad portion 1 of the wrist cushion.

The transparent shell portion 2 containing mono or dual liquids 11 and ornamental floating articles 22 may have different contours designed according to configuration and size of the pad portion 1. For example, when the pad portion 1 has a curved configuration, the transparent shell portion 2 may be correspondingly designed to have the same curve and size as the pad portion 1.

The top portion 3 is made of a soft, transparent, and elastic material, such as silicon rubber or any other elastomer providing equivalent effect, and has a proper thickness. The top portion 3 is bonded to and covers a whole top of the pad portion 1 and the shell portion 2, so that the wrist cushion has a complete, soft, and elastic outer surface. The top portion 3 made of, for example, silicon rubber also protects the shell portion 2 against undesired piercing by some pointed or sharp things to result in leakage of internal liquid 11. Since both the top portion 3 and the shell portion 2 are transparent, movements of the mono or dual liquids 11 and the ornamental articles 22 floating over the liquids 11 can be clearly seen from outside of the wrist cushion. With a fluidity of the mono or dual liquids 11, the ornamental floating articles 22 always drift over the liquids 11 to create dynamic views in the shell portion 2, making the whole wrist cushion of the present invention more attractive to users.

What is claimed is:

1. A wrist cushion comprising:

a) a pad portion forming a base of the wrist cushion;

b) a shell portion connected to an upper side of the pad portion, the pad portion and the shell portion defining an interior space;

c) a top portion connected to the upper side of the pad portion and covering the shell portion;

d) at least one liquid movably contained in the interior space of the wrist cushion; and e) at least one ornamental article floating on the at least one liquid and movably contained in the interior space of the wrist cushion.

2. The according to claim 1, wherein the shell portion and top portion are transparent.

3. The according to claim 1, wherein the pad portion and the shell portion are formed integrally.

4. The according to claim 1, wherein the at least one type of liquid includes two liquids.

5. The according to claim 4, wherein the at least one ornamental article floats on one of the two liquids.

6. The according to claim 1, wherein the top portion is made of a material selected from the group consisting of silicon rubber, elastic material, and an elastomer.

7. The according to claim 1, wherein the at least one ornamental article comprises a plurality of ornamental articles.

* * * * *